US007532810B2

(12) United States Patent
Jayaram et al.

(10) Patent No.: US 7,532,810 B2
(45) Date of Patent: May 12, 2009

(54) PORTABLE ELECTRICAL APPLIANCE WITH DIAGNOSTIC SYSTEM

(75) Inventors: Jaideep Jayaram, Milford, MA (US); Paul Powers, Grafton, MA (US); Robert Sherwood, El Paso, TX (US); Carlos Alberto Natividad, El Paso, TX (US)

(73) Assignee: Sunbeam Products, Inc., Boca Raton, FL (US)

( * ) Notice: Subject to any disclaimer, the term of this patent is extended or adjusted under 35 U.S.C. 154(b) by 2 days.

(21) Appl. No.: 11/524,685

(22) Filed: Sep. 21, 2006

(65) Prior Publication Data

US 2007/0077042 A1 Apr. 5, 2007

Related U.S. Application Data

(60) Provisional application No. 60/719,471, filed on Sep. 22, 2005.

(51) Int. Cl.
*F24F 6/00* (2006.01)
*A45D 20/00* (2006.01)

(52) U.S. Cl. ..... 392/390; 392/385; 392/380; 392/360; 34/266; 34/89; 34/90; 34/96; 34/97; 34/268; 34/283; 374/121; 374/133; 374/208

(58) Field of Classification Search ..... 392/390, 392/385, 380, 360; 34/266, 89–90, 96–97, 34/268, 283; 374/121, 133, 208
See application file for complete search history.

(56) References Cited

U.S. PATENT DOCUMENTS 5,442,154 A * 8/1995 Philippe et al. ..... 219/121.62
5,560,121 A * 10/1996 Fertig et al. ..... 34/90
7,309,216 B1 * 12/2007 Spadola et al. ..... 417/18

* cited by examiner

*Primary Examiner*—Shawntina Fuqua
(74) *Attorney, Agent, or Firm*—Hoffmann & Baron, LLP

(57) ABSTRACT

A portable heater incorporates a housing, heating element, outlet for heat generated by the heating element, and diagnostic testing capabilities that test for defective or abnormal conditions of various safety features and report their status. The features include an object sensing or cover detect function, which operates to disconnect the heater from the primary power source in the event an object is detected that may obstruct the heater outlet, a tilt sensor, which detects whether the heater has been tilted, a fuse, and a positive temperature coefficient (PTC) breaker. The diagnostic testing function preferably receives power directly from the primary source of power to enable the status of the tests to be displayed whenever the heater is plugged in. Light emitting diodes preferably provide backlighting to icons representing the various features to indicate their status to the user.

20 Claims, 12 Drawing Sheets

PORTABLE ELECTRICAL APPLIANCE WITH DIAGNOSTIC SYSTEM

CROSS-REFERENCE TO RELATED APPLICATION

This application claims the benefit of U.S. Provisional Patent Application No. 60/719,471 filed Sep. 22, 2005, the disclosure of which is incorporated herein by reference.

BACKGROUND OF THE INVENTION

1. Field of the Invention

The present invention relates to portable electrical appliances, such as warm-mist humidifiers or electric heaters, and more particularly relates to a portable electrical appliance capable of performing diagnostic tests and displaying the results of these tests.

2. Description of the Related Art

Portable electric household appliances, such as heaters of the type used in the home or office, are often equipped with various features, such as tilt switches, which are configured to turn the heater off when the heater is tipped over, and safety fuses. These heaters may also include proximity sensors that shut the heater off if another object is too close to it. Heaters have also been provided with sensors for determining whether an object is too close to the heater outlet.

There is always a possibility that a heater can malfunction during use. This malfunction may or may not impede its primary purpose, which is to provide heat. However, some malfunctions, such as those concerning safety features of the heater, may be just as important to the user as getting warm. In fact, malfunctions in safety features are particularly hazardous because they are often unnoticeable to the user due to the unimpeded operation of the heater.

A diagnostic system is designed to implement a routine, in which steps are undertaken to locate and identify a malfunction. Typically, in computer-based diagnostic systems, a program is executed and a series of electronic elements are monitored by the system to diagnose malfunctions. The electronic elements can include sensors and/or elements, such as portions of a computer.

The potential for serious life threatening injury from heaters makes their safe operation imperative to the consumer. Therefore, there is a need for an electric heater that is able to conduct diagnostic testing of various features incorporated into the heater to ensure that defective conditions do not exist in advance of requiring their use.

SUMMARY OF THE INVENTION

In accordance with the present invention, a portable household electric appliance, such as a warm-mist humidifier or heater incorporates a housing, a heating element, an outlet for heat generated by the heating element, and diagnostic testing capabilities that test for the occurrence of a defective or abnormal condition and/or monitor the operability of various features and report their status. The features preferably include an object sensing or cover detect function, which operates to disconnect the heater from the primary power source in the event an object, such as a blanket, is detected that may obstruct the heater outlet, a tilt sensor, which detects whether the heater has been tilted, a fuse, and a positive temperature coefficient (PTC) breaker.

Regarding the object sensing function, a transmitter is mounted to the housing near the outlet and is capable of transmitting a beam of radiation. A receiver is mounted to the housing in opposing relation to the transmitter. The receiver is positioned to receive the beam of radiation form the transmitter. A control circuit is provided for disconnecting the heating element from the power source in response to interruption of the beam between the transmitter and the receiver.

In a preferred embodiment, the transmitter is an infrared transmitter and the receiver is an infrared receiver, both of which are positioned above the outlet. The heater preferably includes an encoder for encoding the beam from the transmitter. A decoder is preferably provided for determining whether a valid signal has been received by the receiver from the transmitter. If a correct signal has not been received within a preselected period of time, the heater is disconnected from the power source.

The diagnostic testing function preferably receives power directly from the primary source of power, such as a 110 VAC line supply, to enable the status of the tests to be displayed whenever the heater is plugged in. Light emitting diodes (LEDs) preferably provide backlighting to icons representing the various features to indicate their status to the user.

In further accordance with the present invention, a portable electric appliance is provided, which includes at least one electrically operable element and a diagnostic testing circuit adapted to determine operability of the electrically operable element. The electrically operable element may include a tilt switch, breaker, fuse, and/or object sensing circuit, and the portable electric appliance may include a heater, a humidifier, dehumidifier, and/or fan.

The diagnostic testing circuit may determine operability of the electrically operable element by detecting a voltage, signal, and/or ground associated with the electrically operable element. The diagnostic testing circuit indicates operability of the electrically operable element visually and/or audibly. The diagnostic testing circuit is electrically coupled to a power source such that operability of the electrically operable element can be determined in response to the portable electric appliance being connected to power and/or turned on.

The diagnostic testing circuit may determine operability of the electrically operable element in response to user activation, periodically, in response to the portable electric appliance being connected to power, and/or in response to the portable electric appliance being turned on. The diagnostic testing circuit may include a microcontroller, application specific integrated circuit (ASIC), and/or microprocessor. The object sensing circuit may include a transmitter adapted to transmit a beam of radiation and a receiver responsive to the beam of radiation. The portable electric appliance may be de-energized in response to the beam of radiation being blocked and/or interrupted.

In yet further accordance with the present invention, a method of diagnosing a failure in a portable electric appliance is provided, which includes providing at least one electrically operable element and testing a voltage associated with the electrically operable element to determine operability of the at least one electrically operable element. Providing the electrically operable element may include providing a tilt switch, breaker, fuse, and/or an object sensing circuit. Operability of the electrically operable element may be indicated visually and/or audibly.

The method may also include coupling the diagnostic testing circuit electrically to a power source such that operability of the at least one electrically operable element can be determined in response to the portable electric appliance being connected to power and/or turned on. The method may also include determining operability of the electrically operable element in response to user activation, periodically, in response to the portable electric appliance being connected to power, and/or in response to the portable electric appliance being turned on. The method may also include transmitting a beam of radiation, receiving the beam of radiation, and de-energizing the portable electric appliance in response to the beam of radiation being blocked and/or interrupted.

These and other objects, features, and advantages of this invention will become apparent from the following detailed description of illustrative embodiments thereof, which is to be read in connection with the accompanying drawings.

DETAILED DESCRIPTION OF THE PREFERRED EMBODIMENTS

Figure 1:
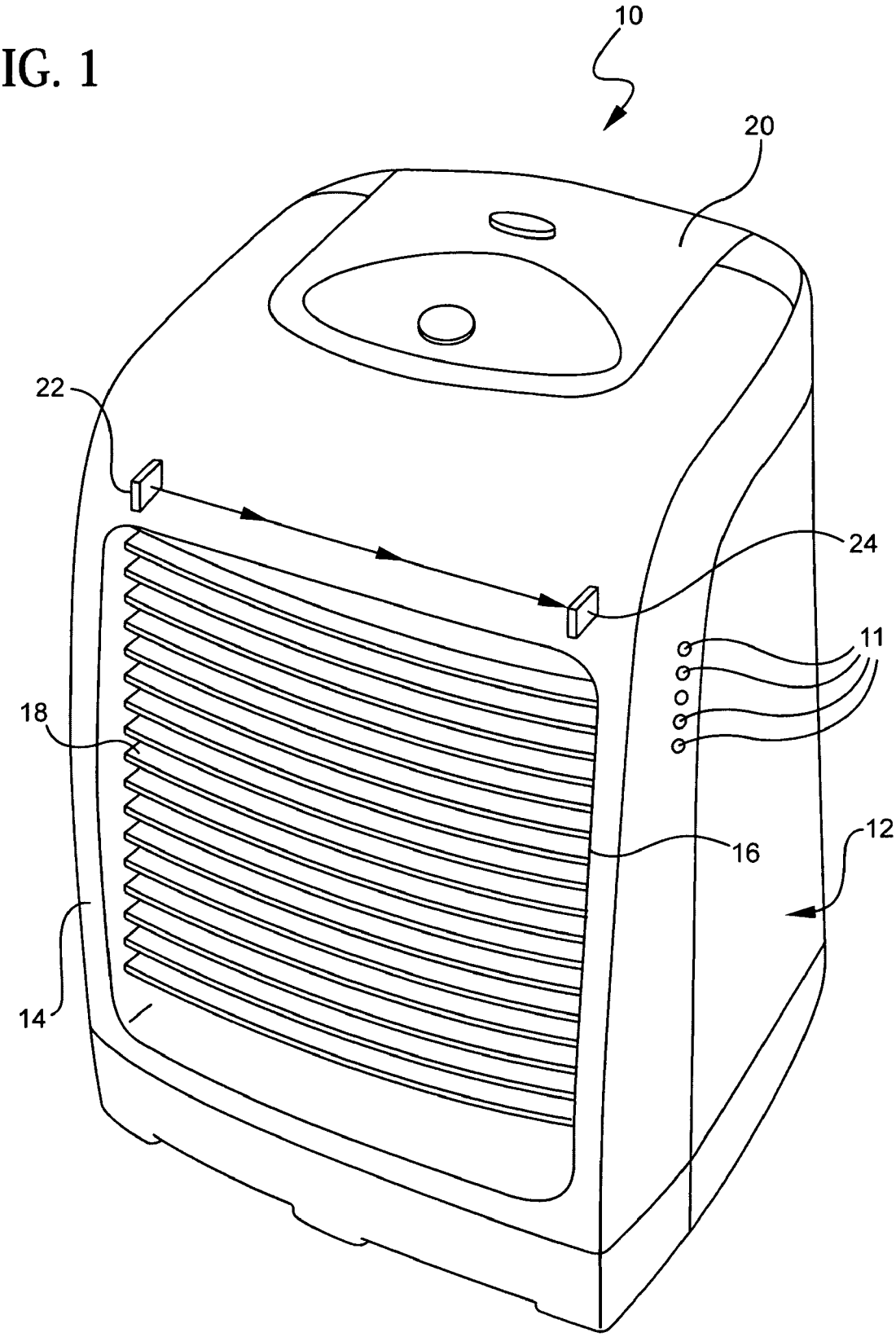
FIG. 1 is a top perspective view of a heater including a diagnostic testing feature and an object sensing assembly in accordance with the invention.

FIG. 1 shows a top perspective view of a portable household heater 10 in accordance with the present invention that includes diagnostic testing and object sensing capabilities. It is to be understood that while the embodiments discussed herein are primarily directed to heaters, the present invention is equally applicable to any portable electric household appliance, such as humidifiers, dehumidifiers, fans, and the like while remaining within the scope of the present invention.

The heater 10 preferably performs a series of diagnostic tests and displays the results of these tests through visual and/or audible indicators, such as light emitting diodes (LEDs) 11, to the user in response to user activation, periodically, in response to the appliance being connected to power, and/or turned on. The object sensing function is preferably verified by one of the diagnostic tests and causes power to be shut off if an object near the heater outlet is sensed.

The heater 10 includes a housing 12 having a front wall 14 that includes an outlet 16. A grill 18 with vanes is provided in the outlet 16. The vanes can be fixed or movable. Other types of heater grills are well known. Some, for example, are comprised of metal panels having rows of circular openings to allow the passage of heated air. The top wall of the heater includes a control panel 20. The control panel may include controls (not shown) for turning the heater on and off, setting the time of operation, adjusting a thermostat, and/or controlling the amount of heat to be generated. These and other controls are known to the art.

The heater 10 shown in FIG. 1 includes one or more heating elements (not shown in FIG. 1) that can be selectively operated. A fan (not shown in FIG. 1) is present within the housing for moving air over the heating elements and through the outlet 16. Air can be drawn into the housing through one or more air inlets (not shown) in the rear wall of the housing or other suitable location. The heating elements can be resistance heating elements. Other types of portable heaters are known to the art, including radiant heaters that do not require the use of a fan. Such heaters may lack a grill.

The heater 10 includes an object sensing assembly that preferably includes at least one radiation transmitter 22 and at least one radiation receiver 24 for receiving signals from the transmitter. As shown in FIG. 1, both the transmitter and receiver are preferably mounted above the outlet 16. If the radiation path between the transmitter and receiver is interrupted, the heater is shut off. As discussed below, the radiation path must preferably be interrupted for a preselected time duration before the heater shuts off. While the heater could be shut off following a momentary interruption, such an arrangement is not preferred.

The locations of the transmitter 22 and receiver 24 above the outlet, as shown, are preferred. Obstructions, such as drapes or clothing items that may extend over the heater, will be readily detected. The transmitter 22 and receiver 24 preferably extend only a short distance from the front wall and are unobtrusive. Each is preferably positioned near a side wall of the heater. The distance between the transmitter 22 and receiver 24 preferably at least generally corresponds to the maximum width of the outlet 16.

Figure 2:
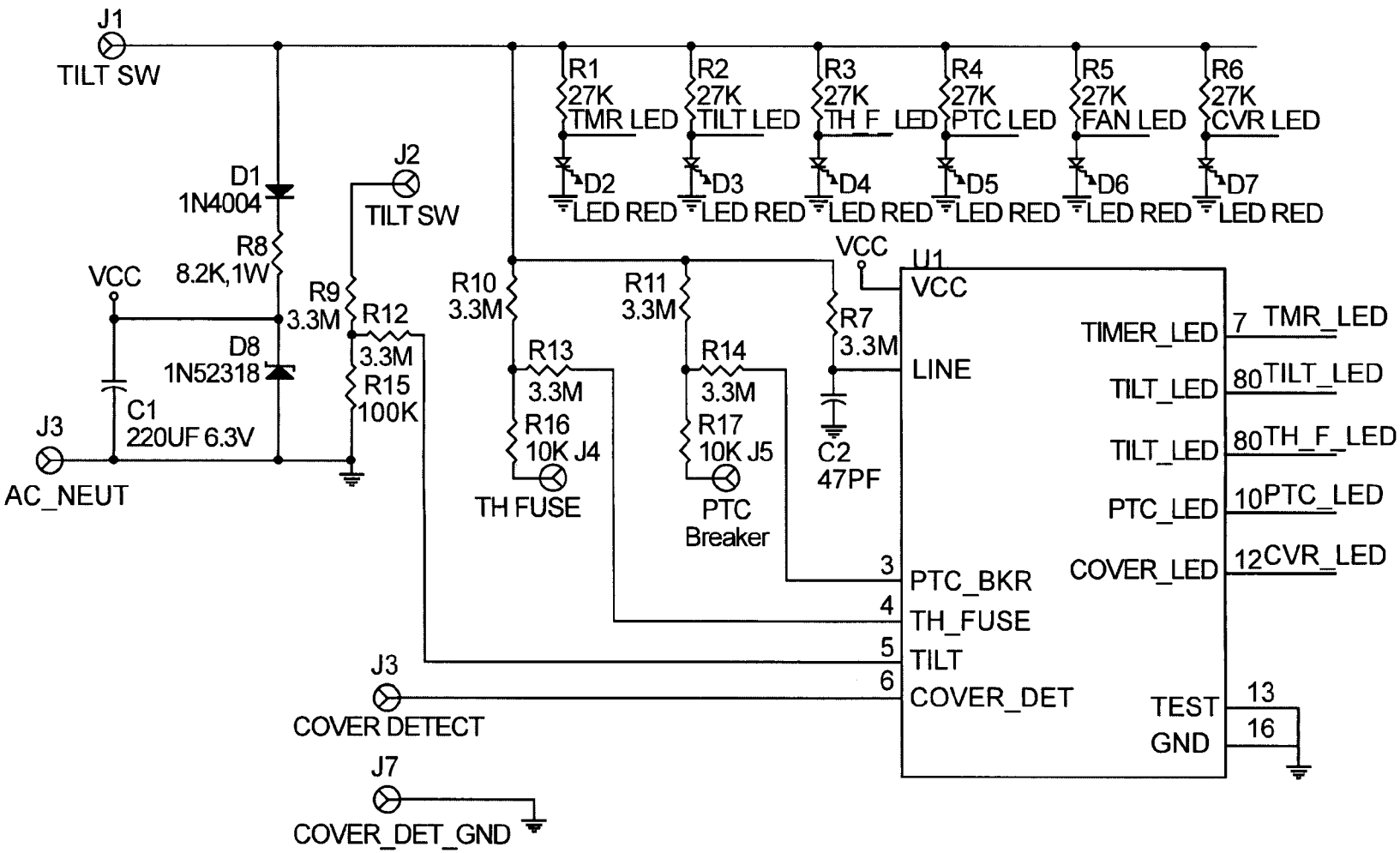
FIG. 2 is a schematic diagram of a first embodiment of a circuit to perform a diagnostic testing function in accordance with the present invention.

FIG. 2 shows a schematic diagram of a first embodiment of a diagnostic testing circuit 26 in accordance with the present invention. The diagnostic circuit 26 preferably includes a safety check application specific integrated circuit (ASIC) U1, (but may also a microcontroller and/or microprocessor while remaining within the scope of the present invention) which is connected to a 5 VDC power supply (VCC) at pin 1. VCC is preferably derived from a 110 VAC power source provided at connector J1 through operation of a diode D1, capacitor C1, zener diode D8, and resistor R8. Capacitor C1 and zener diode D8 are preferably connected in parallel across the 5 VDC supply and the 110 VAC neutral or return provided at connector J3. Diode D1 essentially half-wave rectifies the 110 VAC supply, and resistor R8 limits the current applied to zener diode D8. Zener diode D8 essentially clamps the rectified 110 VAC voltage signal to about 5 VDC, and capacitor C1 filters any additional spikes caused by the 110 VAC supply.

The safety check ASIC U1 preferably monitors a tilt switch connected to connector J2, a fuse at connector J4, and a positive temperature coefficient (PTC) breaker at connector J5. Connector J2 is preferably connected to the neutral or return of the 110 VAC supply at connector J3 through the series connection of resistors R9 and R1 5. Connector J2 is also connected to pin 5 of the safety check ASIC U1 through the series combination of resistors R9 and R12. Similarly, connector J4 is connected to pin 4 of the safety check ASIC U1 through the series combination of resistors R16 and R13, as well as being connected to the 110 VAC supply at connector J1 through the series combination of resistors R10 and R16. Connector J5 is preferably connected to pin 3 of the safety check ASIC U1 through the series combination of resistors R17 and R14, as well as being connected to the 110 VAC supply at connector J1 through the series combination of resistors R11 and R17.

Pin 2 of the safety check ASIC U1 is preferably connected to the 110 VAC supply at connector J1 through a resistor R7, as well as being connected to ground through a capacitor C2. Pin 1 of the safety check ASIC U1 is connected to the 5 VDC supply, and pins 13 and 16 are connected to ground. Pin 5 of the safety check ASIC U1 is connected to connector J6, which may be connected to pin 7 of a cover detect ASIC U2 shown in FIG. 3, which is discussed in further detail below.

LEDs D2-D7 indicate the results of diagnostic tests concerning the status of various features of the heater in accordance with the present invention. Specifically, LED D2 indicates whether the heater is operating in a timer mode, LED D3 indicates whether the tilt switch is defective and whether the heater is tilted, LED D4 indicates whether the fuse is defective, LED D5 indicates whether the PTC breaker is defective, LED D6 indicates whether a fan is on, and LED D7 indicates whether the object sensing or cover detect feature is defective and whether the heater is currently covered. The anode of each of diodes D2-D7 is preferably connected to the 110 VAC supply through one of the resistors R1-R6, respectively. Pins 7, 80, 91, 10, and 12 are preferably connected to the anodes of LEDs D2-D5 and D7, respectively.

Figure 3:
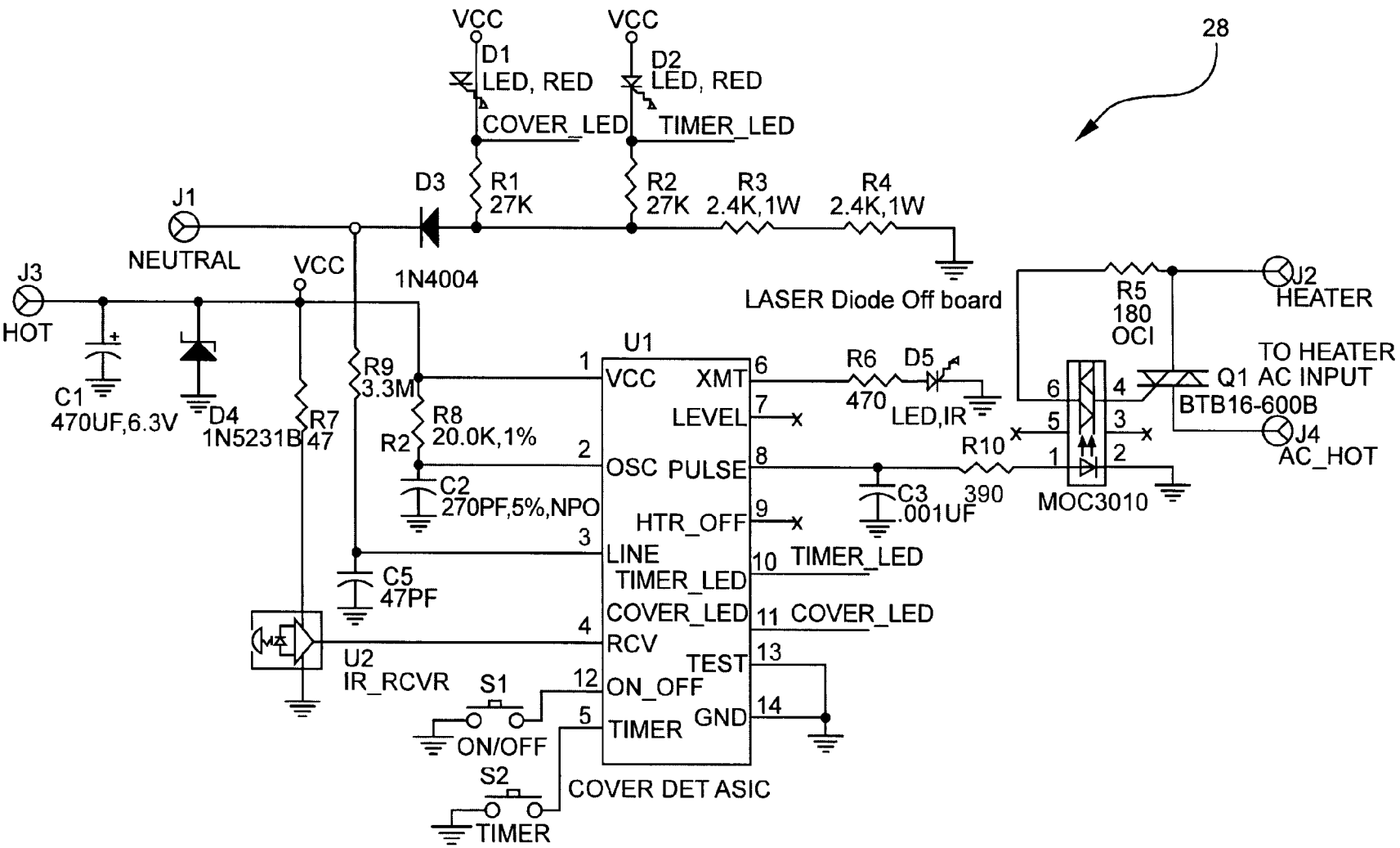
FIG. 3 is a schematic diagram of a first embodiment of a circuit to perform an object sensing function in accordance with the present invention.

FIG. 3 is a schematic diagram of a first embodiment of a circuit 28 to perform the object sensing or cover detect function. The object sensing circuit 28 preferably includes a cover detect ASIC U1, which is connected at pin 1 to a 5 VDC power supply provided by operation of zener diode D4 and capacitor C1. Capacitor C1 and zener diode D4 are connected in parallel across ground and a 110 VAC power supply, which is coupled to connector J3. Specifically, the anode of zener diode D4 is connected to ground and the cathode of zener diode D4 is coupled to connector J3. The 5 VDC power source is thus made available at the cathode of zener diode D4.

The frequency of a clock signal internal to the cover detect ASIC U1 is controlled by resistor R8 and capacitor C2. Specifically, resistor R8 is preferably connected in series between pins 1 and 2 of the cover detect ASIC U1. Capacitor C2 is preferably connected in series between pin 2 of the cover detect ASIC U1 and ground.

The neutral or ground connection associated with the 110 VAC power supply is preferably coupled to connector J1 and provided through resistor R9 to pin 3 of the cover detect ASIC U1. Capacitor C5 is connected in series between the cover detect ASIC U1 and ground, thus providing a direct connection between the 110 VAC line voltage and the cover detect ASIC U1 at pin 3 to enable it to operate whenever the heater is plugged in.

The output of an infrared (IR) receiver U2, incorporated as part of the receiver assembly 24 shown in FIG. 1, is preferably connected to pin 4 of the cover detect ASIC U1. The IR receiver U2 is connected to the 5 VDC power source (VCC) through a filter, which includes resistor R7 and capacitor C4. Specifically, capacitor C4 is connected in series between the IR receiver U2 and ground, and resistor R7 is connected in series between the IR receiver U2 and the 5 VDC power source. The IR receiver U2 is also connected to ground.

A switch S1 is preferably connected in series between pin 12 of the cover detect ASIC U1 and ground, and a switch S2 is preferably connected in series between pin 5 of the cover detect ASIC U1 and ground. Switch S1 is preferably used to manually turn the heater on and off, and switch S2 is preferably used to enable or disable a timer mode. The timer mode enables the heater to remain on for a predetermined period of time and to thereafter automatically turn off.

Switch S1 preferably controls the on/off status by disabling the triacs switching 110 VAC supply to the heating elements. The power will be off by default (at power-on), and each push of the button preferably changes the status to on-off-on-off, etc. A power LED is preferably not required, but can be included while remaining within the scope of the present invention. If the cover detect ASIC is to be used in conjunction with an existing manual or automatic heater controller, the unused power button pin is preferably connected to ground.

Switch S2 preferably controls an internal timer that turns the heater off in 4 hours. Power is preferably provided before the timer can be used. The timer LED remains illuminated when the timer has been activated properly and flashes at the rate of 400 ms on, 400 ms off, etc. following the expiration of 4 hours to indicate to the user that the heater is off because the timer has expired. If switch S2 is activated while the timer is active, the timer function is preferably cancelled, and the timer LED will turn off. If the heater status is off due to a time-out of the timer function, only the power button can preferably change the status back to on. As part of this sequence, the timer LED is also preferably turned back on.

The cathode of diode D3 is preferably connected to the neutral or return of the 110 VAC supply at connector J1 and half-wave rectifies the 110 VAC supply to provide a negative power supply available at the anode of diode D3. Resistors R3 and R4 are preferably connected in series between the anode of diode D3 and ground, which function to limit the current through diode D3. Current flows from the hot side of the AC line at connector J3 through zener diode D4, resistor R4, resistor R3, diode D3, and back to the neutral side of the AC line at connector J1 producing voltage across zener diode D4. Since zener diode D4 is connected from VCC to ground, a regulated voltage is created.

Diode D1 preferably indicates when the heater is covered, and diode D2 indicates when the heater is in the timer mode. The anode of diode D1 is preferably connected to the 5 VDC supply and its cathode is connected to pin 11 of the cover detect ASIC U1. Resistor R1 is connected in series between pin 111 of the cover detect ASIC U1 and the cathode of diode D1.

Similarly, the anode of diode D2 is preferably connected to the 5 VDC supply and its cathode is connected to pin 10 of the cover detect ASIC U1. Resistor R2 is preferably connected in series between pin 10 of the cover detect ASIC U1 and the cathode of diode D2. Thus, in response to pin 11 of the cover detect ASIC U1 being substantially grounded, diode D1 is illuminated, and in response to pin 11 being at or near 5 VDC, the diode D1 is turned off. Diode D2 operates in a similar manner in response to control by voltage levels output on pin 10 of the cover detect ASIC U1.

The cathode of infrared (IR) LED D5 is preferably connected to ground and a resistor R6 is connected in series between pin 6 of the cover detect ASIC U1 and the anode of IR LED D5. The IR LED D5 is incorporated in the transmitter assembly 22 shown in FIG. 1 and provides the infrared signal to be received by the IR receiver U2, as described above.

Pin 8 of the cover detect ASIC U1 is preferably connected through resistor R10 to pin 1 of an optoisolated triac driver MOC3010, which is commercially available from Fairchild Semiconductor Corporation (www.fairchildsemi.com). Further details concerning the triac driver MOC3010 are provided in the *Random-Phase Optoisolators Triac Driver Datasheet*, Fairchild Semiconductor Corporation, pp. 1-10 (2005), which is incorporated herein by reference. Capacitor C3 is connected in series between pin 8 of the cover detect ASIC U1 and ground, and operates to filter spikes that may occur on the AC supply to the heater. A triac Q1 selectively switches the 110 VAC supply coupled to connector J4 to the heater, which is coupled to connector J2. Pin 4 of the triac driver MOC3010 is preferably connected to a gate of the triac Q1 and operates to control switching of the 110 VAC supply to the heater. Resistor R5 is preferably connected in series between connector J2 and pin 6 of the triac driver MOC3010 to limit the gate current provided to the triac Q1.

Figure 4:
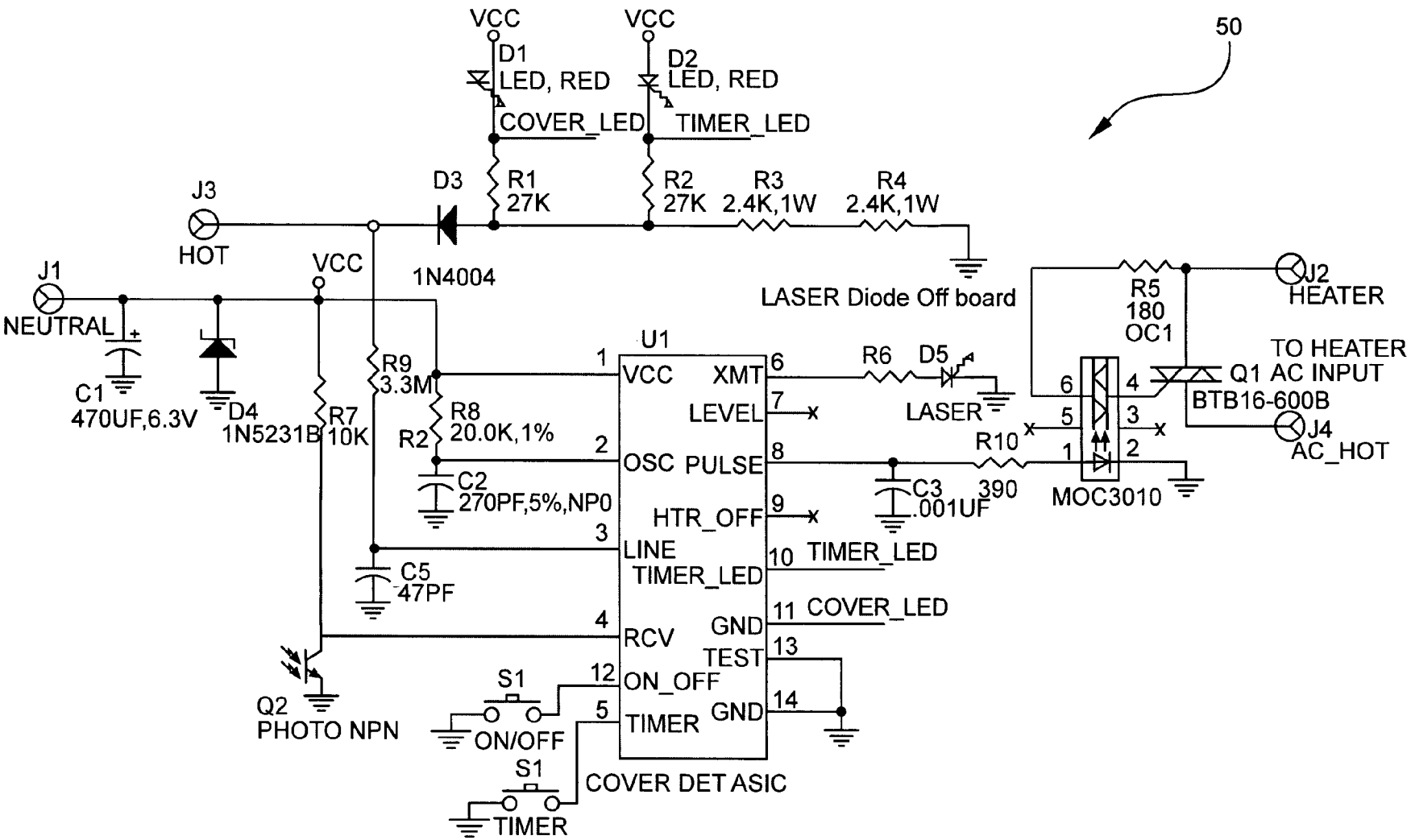
FIG. 4 is a schematic diagram of a second embodiment of a circuit to perform the object sensing function in accordance with the present invention.

FIG. 4 is a schematic diagram of a second embodiment of a circuit 50 to perform the object sensing function. The circuit 50 is substantially similar to that shown in FIG. 3, except that the IR diode D5 has been replaced with a laser diode D5 and the IR receiver U2 has been replaced with a photo-sensitive transistor Q2. In addition, the value of resistor R7 has been modified and capacitor C4 has been eliminated to accommodate the different electrical characteristics of the photo-sensitive transistor Q2.

Figure 5:
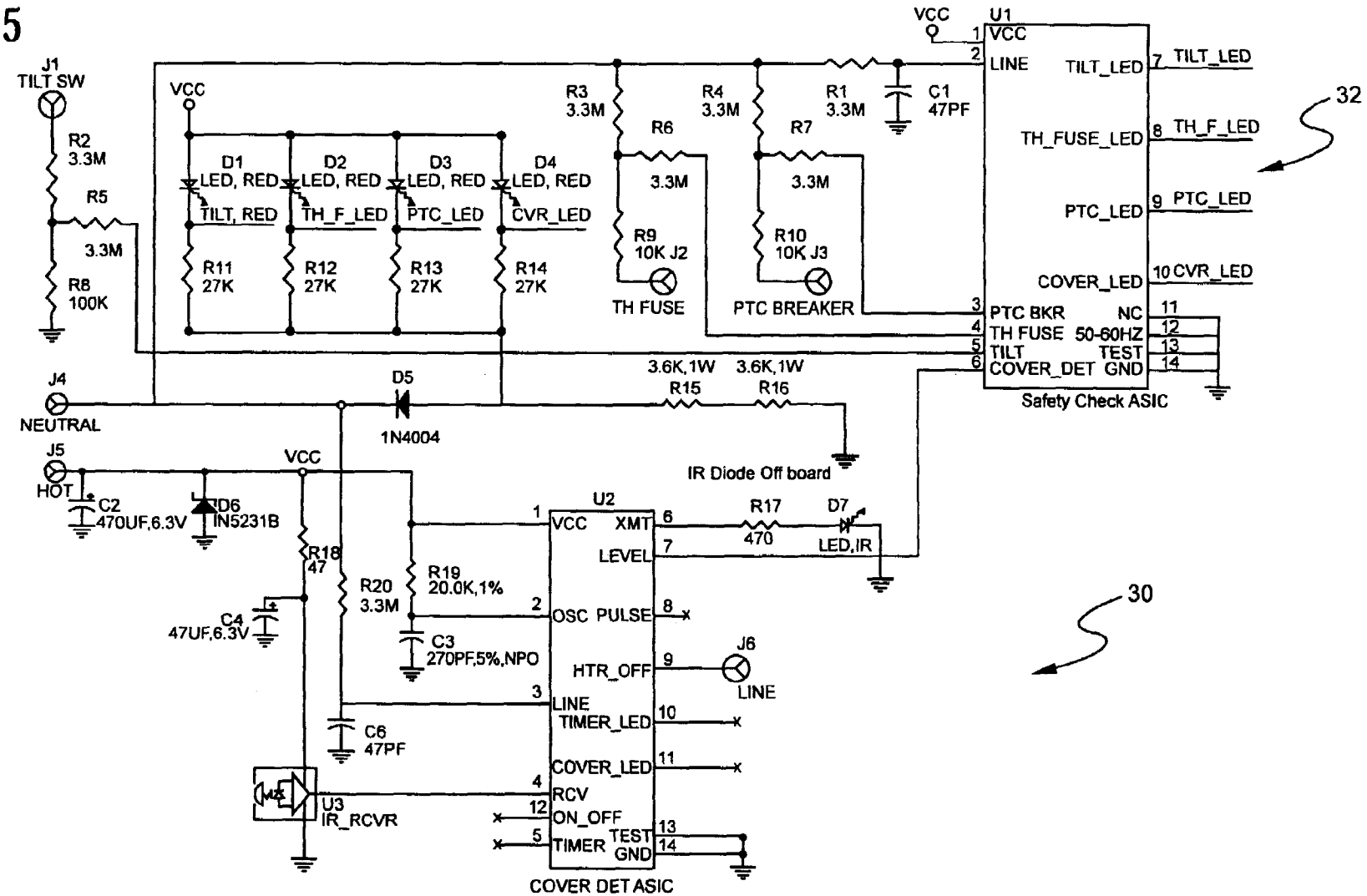
FIG. 5 is a schematic diagram of a third embodiment of a circuit to perform the object sensing function and diagnostic testing function in accordance with the present invention.

FIG. 5 is a schematic diagram of a third embodiment of an object sensing circuit 30 to perform the object sensing function, which also incorporates a second embodiment of a diagnostic circuit 32 in accordance with the present invention. Regarding the object sensing function, the third embodiment is essentially the same as the first embodiment described in connection with FIG. 3, except that the on/off switch and timer mode have not been implemented in the second embodiment, and thus switches S1, S2, diode D2, and the circuitry associated therewith have been omitted. In addition, indication of the cover detect function is provided through pin 7 of the cover detect ASIC U2, which is connected to pin 6 of a safety check ASIC U1 for this purpose.

The Cover Detect circuit preferably detects if an object (such as a blanket) covers the heater by checking for the presence of an infrared signal received from the infrared transmitter. If a fault is detected, the cover detect ASIC stops the heater operation by disabling TRIAC pulses on automatic heaters, such as that shown in FIG. 5, or by interrupting the 110 VAC supply in manual heaters, such as that shown in FIGS. 3 and 4.

When the infrared path is blocked, the LED that indicates the cover detect feature is preferably turned on. The cover detect ASIC preferably must not receive the correct signal for approximately 2.8 seconds before it will disable the heater, any short interruption (under 2 seconds) is preferably ignored. After a fault is detected and the heater is disabled, transmission of the infrared signal preferably needs to be detected correctly for at least two 400 ms clocks (time elapsed 400 ms to 800 ms), before the cover detect ASIC will reset itself, turn off the cover LED, and re-enable the heater.

The safety check ASIC U1 preferably indicates whether the object sensing or cover detect features are operational when the heater is turned on by operation of the output at pin 10 of the safety check ASIC U1, which may control the illumination of diode D4 in a manner similar to that described above with respect to diode D1 in FIG. 3. For example, if on power-up or at any other time that diagnostics are to be run, the IR beam is received by the IR receiver U3 (that is, the beam is not blocked by an object covering the heater) then a voltage, signal, and/or ground output from pin 7 of the cover detect ASIC U2 will indicate that the cover detect feature is operable. This voltage, signal, and/or ground is input at pin 6 of the safety check ASIC U1 and used to indicate operability of this function via diode D4. It is to be noted that alternative audio and/or visual indicating devices may be used to indicate operability of any or all of the functions verified, such as neon lights, mechanical buzzers, piezo-type devices, and the like, while remaining within the scope of the present invention.

In addition to the cover detect ASIC U1, other elements that can be tested for a defective condition or operability include a PTC breaker, thermal fuse, and tilt switch. Further details regarding operation of the cover detect ASIC U2 and its associated circuitry is provided in Application Ser. No. 60/712,238, filed Aug. 29, 2005, entitled Heater with Object Sensing Assembly, commonly assigned to The Holmes Group, which is incorporated herein by reference.

A further distinction between the third and first embodiments is that the cover detect ASIC U2 in FIG. 5 preferably controls whether the heater is turned off or not through action of the output at pin 9 of the cover detect ASIC U2 rather than pin 8 of the cover detect ASIC U1 shown in FIG. 3. Thus, the heater control circuitry, which includes the triac Q1, optoisolated triac driver MOC3010, resistor R10, and capacitor C3 shown in FIG. 3 have been omitted in FIG. 5. The cover detect ASIC U2 shown in FIG. 5 preferably controls whether or not the heater is turned off by means located in a position remote to the circuit shown in FIG. 5.

The second embodiment of the diagnostic safety circuit 32 shown in FIG. 5 is substantially similar to the first embodiment shown in FIG. 2, except that LEDs to indicate the status of the timer mode and the fan, which is used to circulate heated air, have been eliminated in FIG. 5 since these features are not present in the second embodiment.

Figure 6:
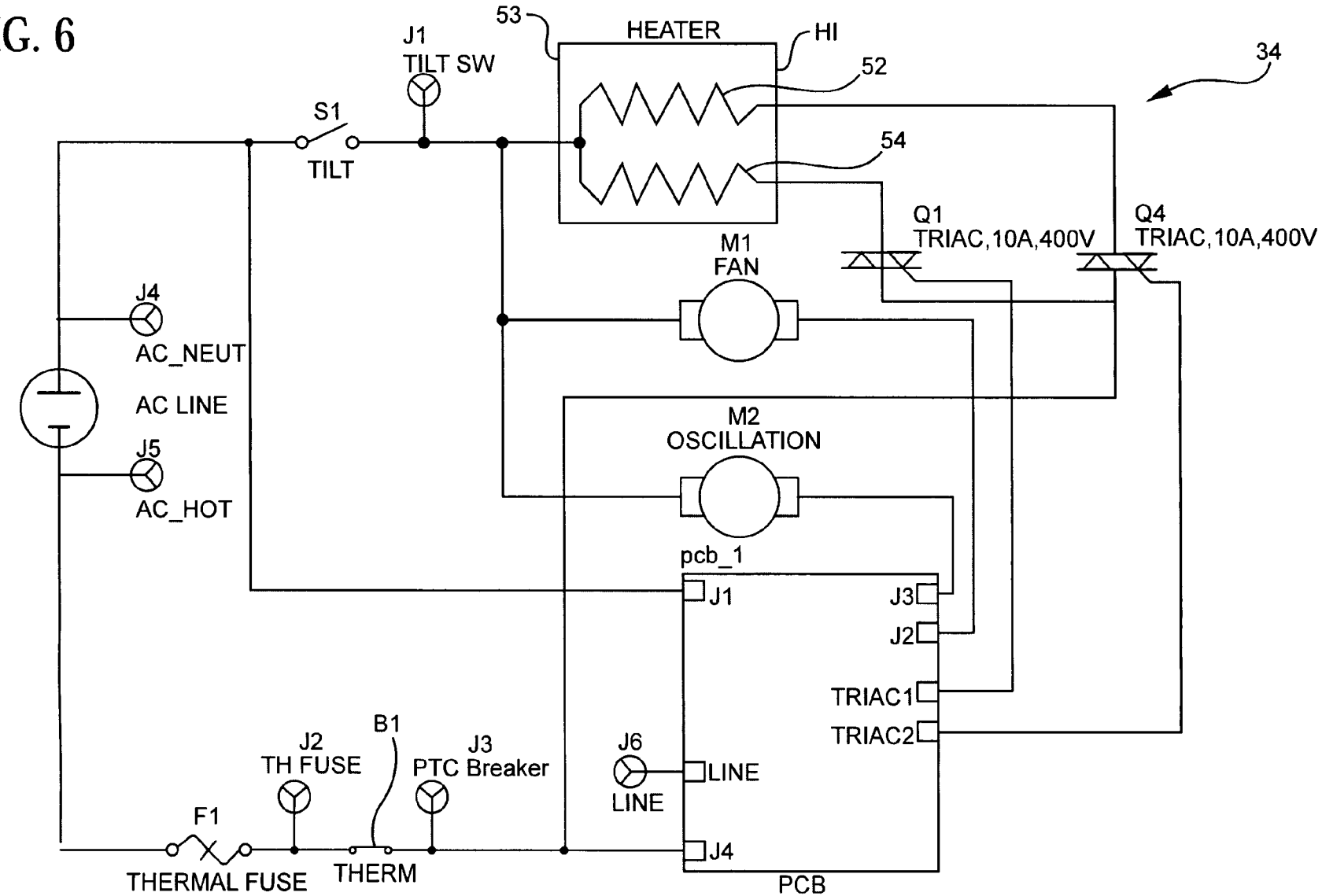
FIG. 6 is a schematic diagram of a preferred embodiment of a heater in accordance with the present invention.

FIG. 6 shows a schematic diagram of a preferred embodiment of a circuit for the heater 10, which may incorporate any of the circuits described above in accordance with the present invention. The heater includes a heater assembly 53 including a pair of resistance heating elements 52, 54. The heating elements can be selectively operated to vary the heat output of the heater. Triacs Q1 and Q4 are connected in series between the respective heating elements 52, 54, and signals provided at connectors TRIAC1 and TRIAC2 of a printed circuit board (PCB) control the operation of the triacs Q1 and Q4, respectively.

A fan motor M1 is provided for causing a fan to blow air by the heating elements, thereby heating the air prior to exiting the outlet 16. The fan is selectively energized by a signal from the PCB at connector J2. An oscillating motor M2 is provided for oscillating the fan, thereby directing heated air in various directions as the fan oscillates back and forth. The oscillating motor is selectively energized by a signal from the PCB at connector J3. The heater can be operated with or without fan oscillation. The heater can also function as a fan when neither heating element is operated.

The heater includes various safety features in addition to the sensing assembly described above and shown in FIGS. 1, 3, 4, or 5. A tilt switch S1 is provided for disconnecting power to the heater assembly 53 and fan M1 and oscillation motor M2 if the heater 10 is tilted beyond a predetermined amount. The tilt switch is connected in series between connector J1 of the PCB and the neutral of the 110 VAC supply at connector J4. A thermal fuse F1 and a positive temperature coefficient breaker B1 are connected in series between the source of AC current and the PCB at connector J4. They are also connected to the triacs Q1 and Q4. Power to the heater assembly 30 is disconnected in the event of an overheat and/or over-current condition by operation of the fuse F1 and/or breaker B1.

Connector J1 in FIG. 6 is preferably connected to connector J1 in FIG. 5, which enables the safety check ASIC U1 to monitor whether or not a specified voltage, signal, and/or ground appears on the internal side of tilt switch S1 (pin 5 of safety check ASIC U1), and thus whether tilt switch S1 is operable. Likewise, connector J2 in FIG. 6 is preferably connected to connector J2 in FIG. 5, which enables safety check ASIC U1 to monitor whether or not there is a specified voltage, signal, and/or ground on the internal side of the fuse F1 S1 (pin 4 of safety check ASIC U1), and thus the operability of fuse F1. Similarly, connector J3 in FIG. 6 is preferably connected to connector J3 in FIG. 5, which enables the safety check ASIC U1 to determine whether or not there is a specified voltage, signal, and/or ground present on the internal side of the breaker B1 S1 (pin 3 of safety check ASIC U1), and thus the operability of breaker B1.

The safety check ASIC U1 shown in FIG. 5 preferably provides an indication of the status of the tilt switch S1, fuse F1, PTC breaker B1, and cover detect circuitry on pins 7-10, respectively, which are connected to indicator LEDs D1-D4 discussed above. A low-level on any of pins 7-10 of the safety check ASIC U1 preferably causes the corresponding LED to be illuminated, and a high-level on any of these pins turns the corresponding LED off.

Regarding any of the embodiments discussed herein, the diagnostic testing system is preferably powered by its own supply that receives power directly from a line cord connected to an AC supply, which enables the diagnostic status to be shown whenever the heater is plugged in. Backlit icons illuminated by the LEDs discussed above preferably indicate the status of the tip-over or tilt switch, PTC breaker, thermal fuse, and cover detect circuitry.

When the heater is first plugged in, the display preferably performs as follows.

1. All LEDs are illuminated.
2. The first LED on the left, which is preferably associated with the tilt switch, will turn off for 266 mS, turn on for 266, turn off for 266 mS, and turn on for 266 mS, and finally turns off and stays off if there is no corresponding fault detected.
3. 532 mS after the sequence in (2) is completed, the next LED, which is preferably associated with the PTC breaker, will turn off for 266 mS, turn on for 266, turn off for 266 mS, turn on for 266 mS and finally turns off and stays off if there is no corresponding fault detected.
4. 532 mS after the sequence in (4) is completed, the next LED, which is preferably associated with the fuse, will turn off for 266 mS, turn on for 266, turn off for 266 mS, turn on for 266 mS and finally turns off and stays off if there is no corresponding fault detected.
5. 532 mS after the sequence in (4) is completed, the next LED, which is preferably associated with the cover detect circuitry, will turn off for 266 mS, turn on for 266, turn off for 266 mS, turn on for 266 mS, and finally turns off and stays off if there is no corresponding fault detected. If the cover detect circuitry is not to be used, the associated LED is preferably left out of the circuit.

The sequence described above preferably only takes place when the heater is first plugged into a wall outlet, but may be initiated at other times in response to, for instance, user selection while remaining within the scope of the present invention.

If the heater is tilted, it is turned off and the LED corresponding to the tilt switch is preferably turned on until the condition is corrected. If the breaker malfunctions, the heater is preferably turned off and the LED corresponding to the breaker is preferably turned on until the condition is corrected. If the fuse malfunctions, the heater is turned off and the LED corresponding to the fuse is preferably turned on until the heater is unplugged. If an object blocks the cover detect beam, the heater is turned off and the LED corresponding to the cover detect function is preferably turned on until the condition is corrected.

Figure 7:
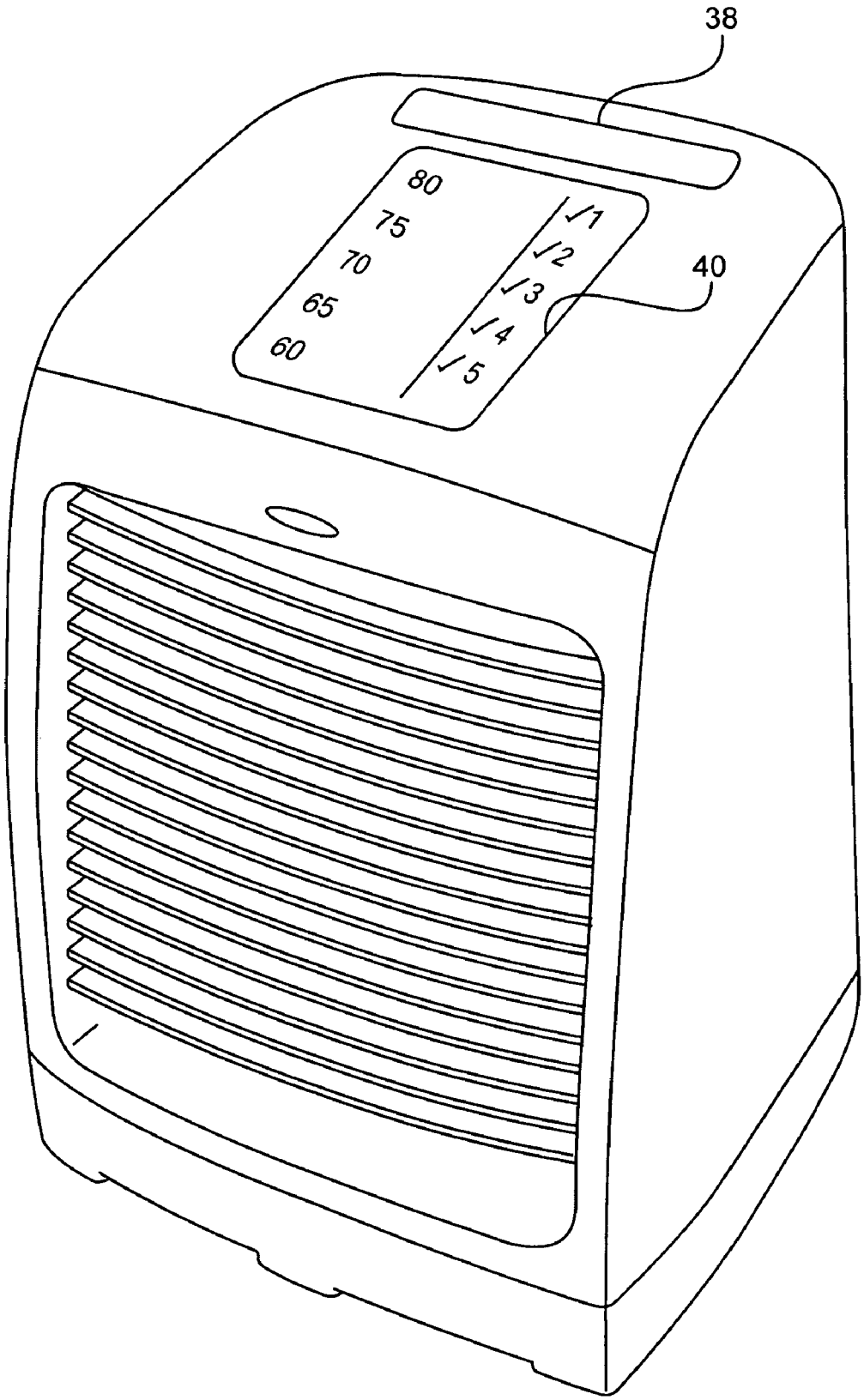
FIGS. 7-12 are top perspective views of various embodiments of the heater in accordance with the present invention.

FIGS. 7-12 show various embodiments of external features of the heater in accordance with the present invention. In FIG. 7, a key or warning label 38 is preferably placed on a top surface of the heater to explain the meaning of a diagnostic display 40, which includes an indication of the status of the unit test. A green check mark preferably appears next to the number of the corresponding diagnostic test if the test has successfully passed and a red "X" is illuminated if the test fails.

Figure 8:
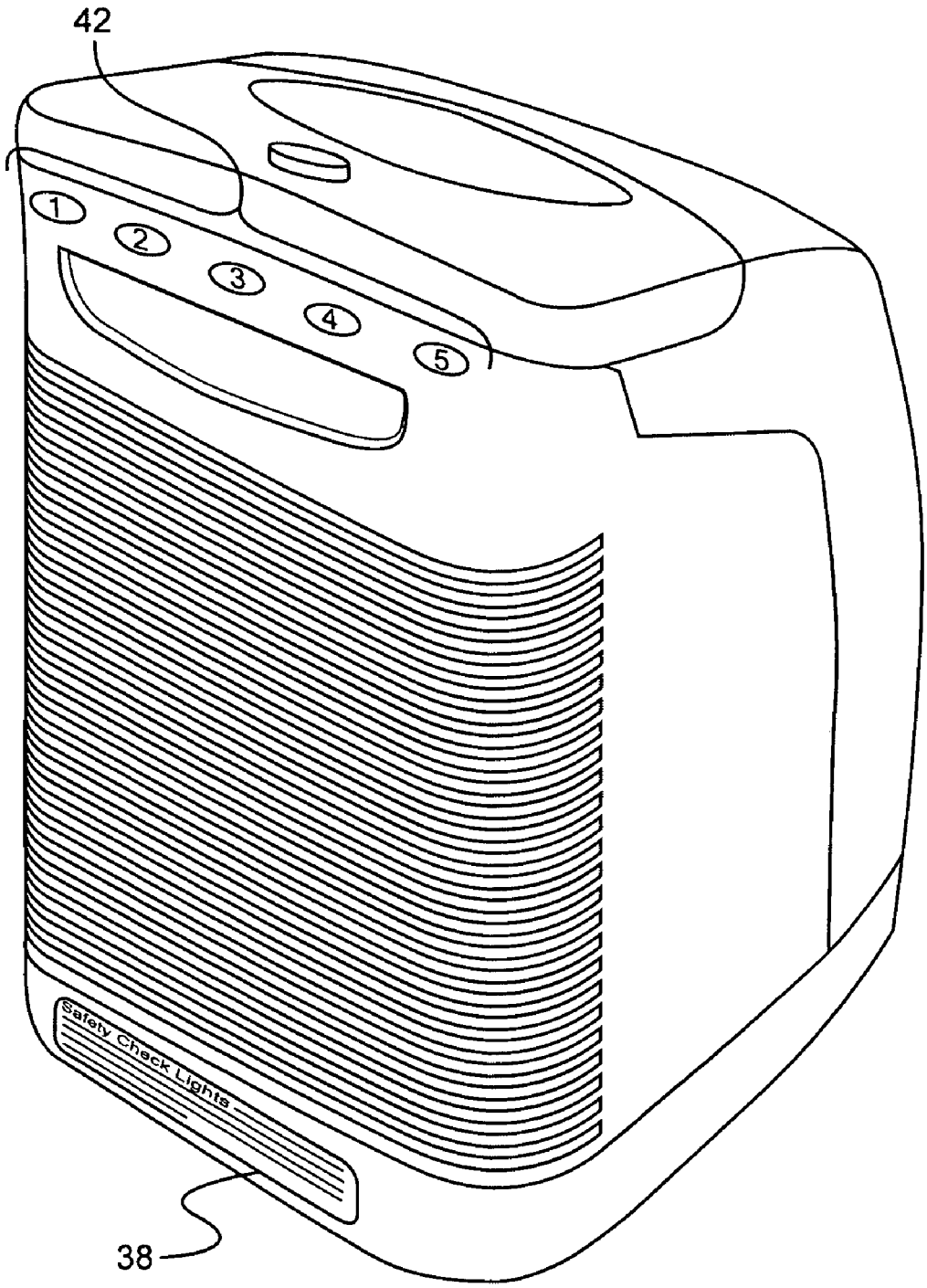
Figure 9:
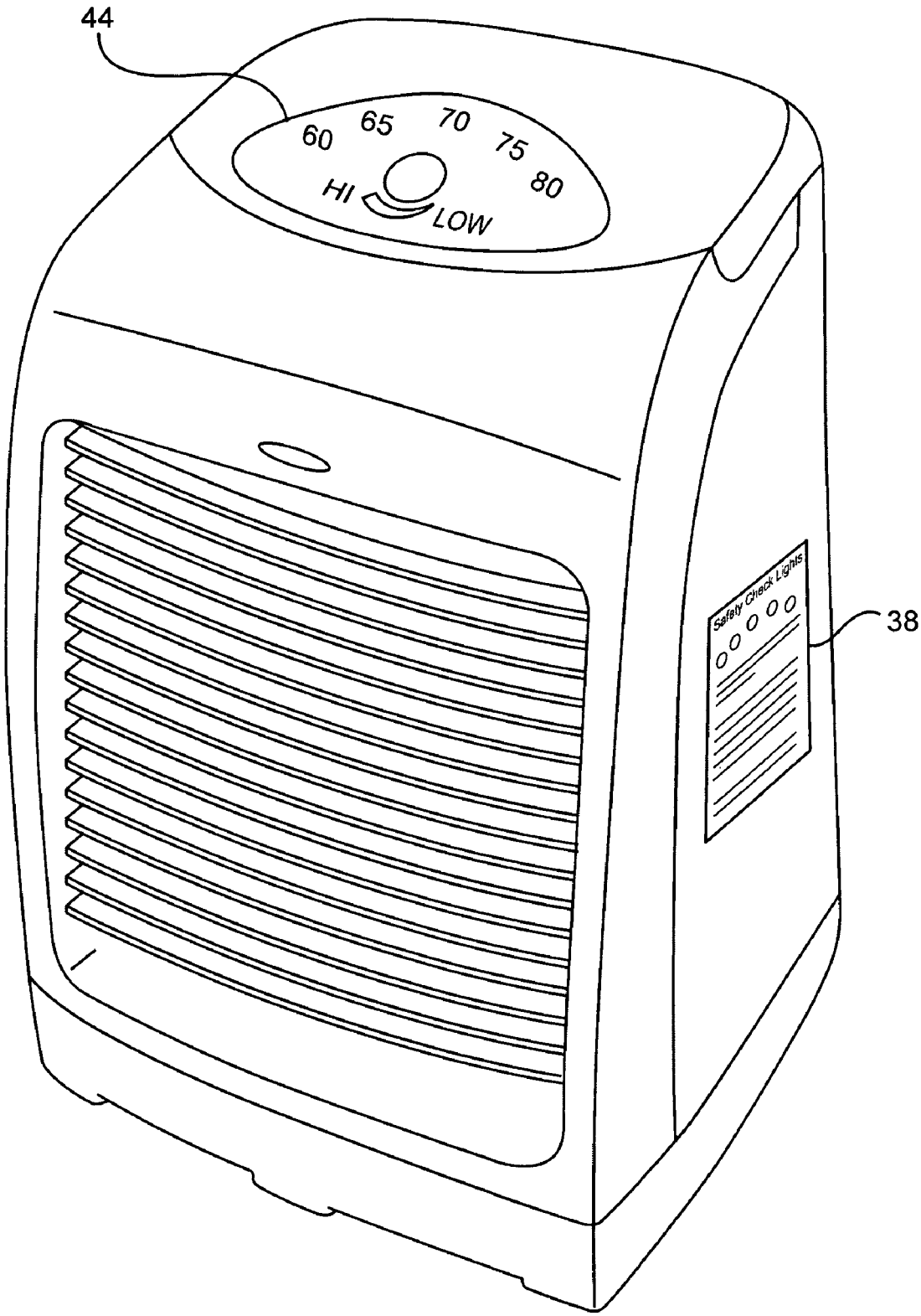
Figure 10:
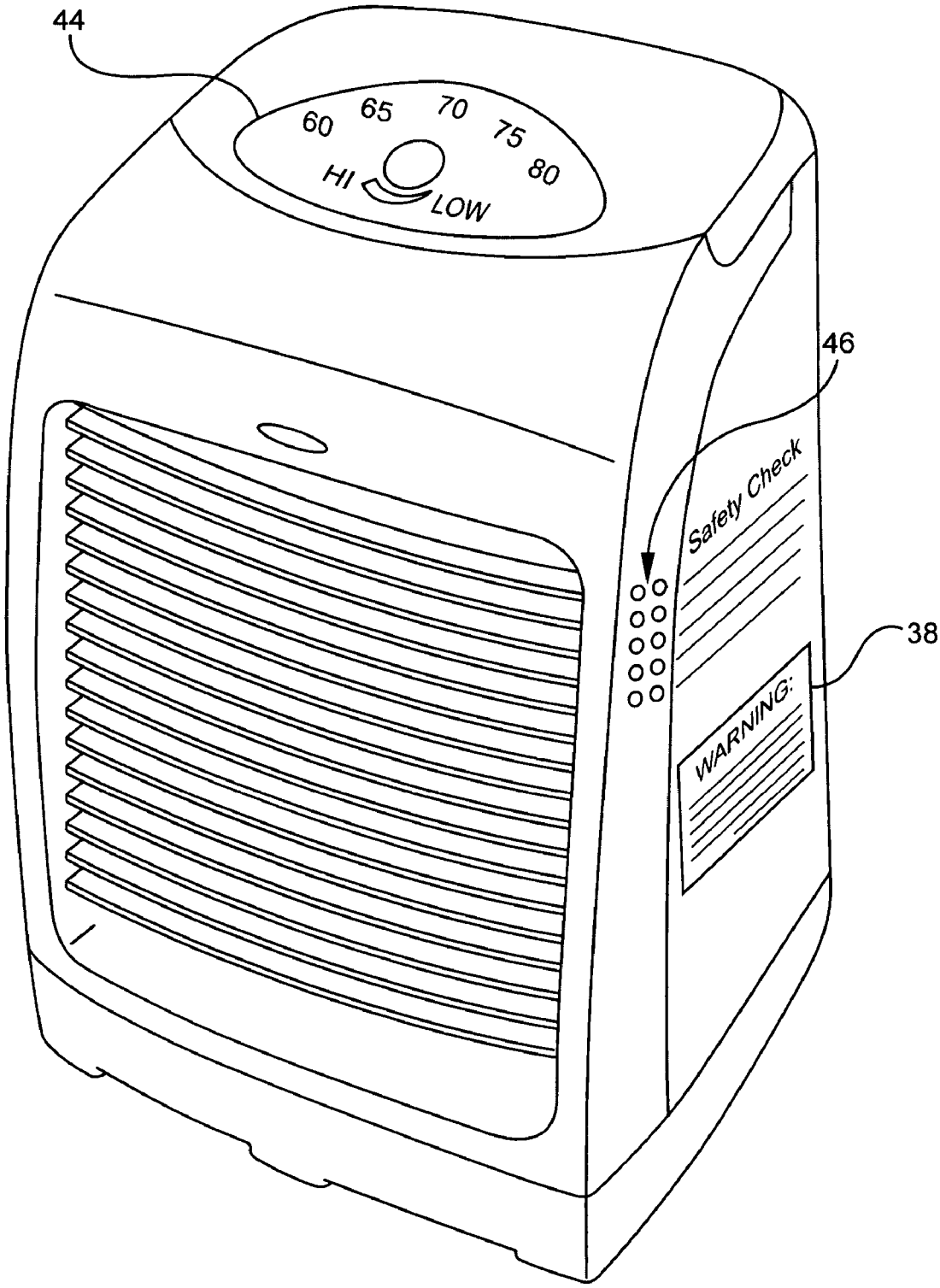

In FIG. 8, the key or warning label 38 is preferably placed at the bottom of the front face of the heater and the status of the various diagnostics is indicated by red and green LEDs 42 along the top front face of the heater. In FIG. 9, the key or warning label 38 is preferably placed on a side face of the heater and the status of the various diagnostics is indicated by LEDs 44 on the top surface of the heater. In FIG. 10, the key or warning label 38 and diagnostic indicators 46 are preferably placed on a side face of the heater.

Figure 11:
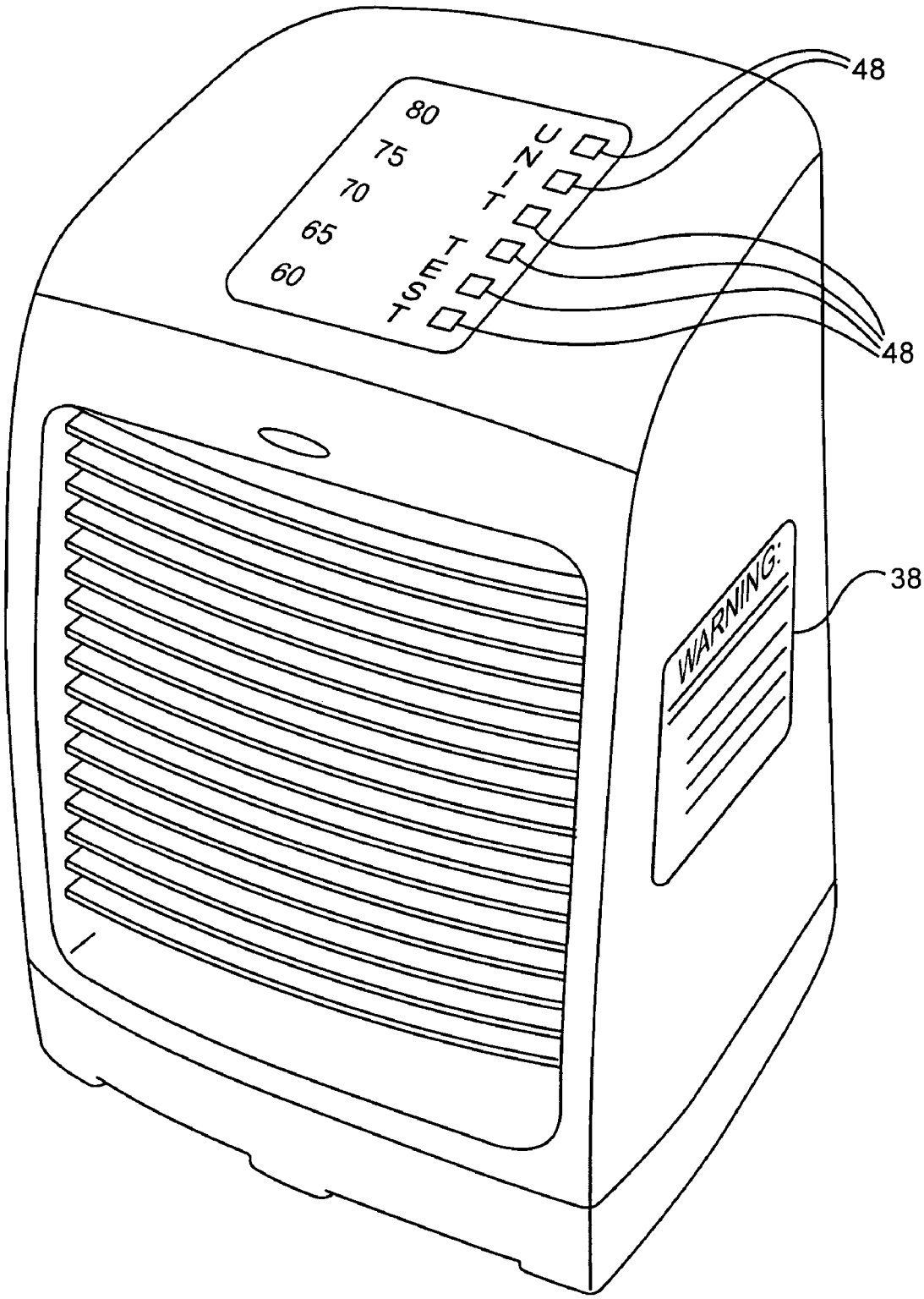
Figure 12:
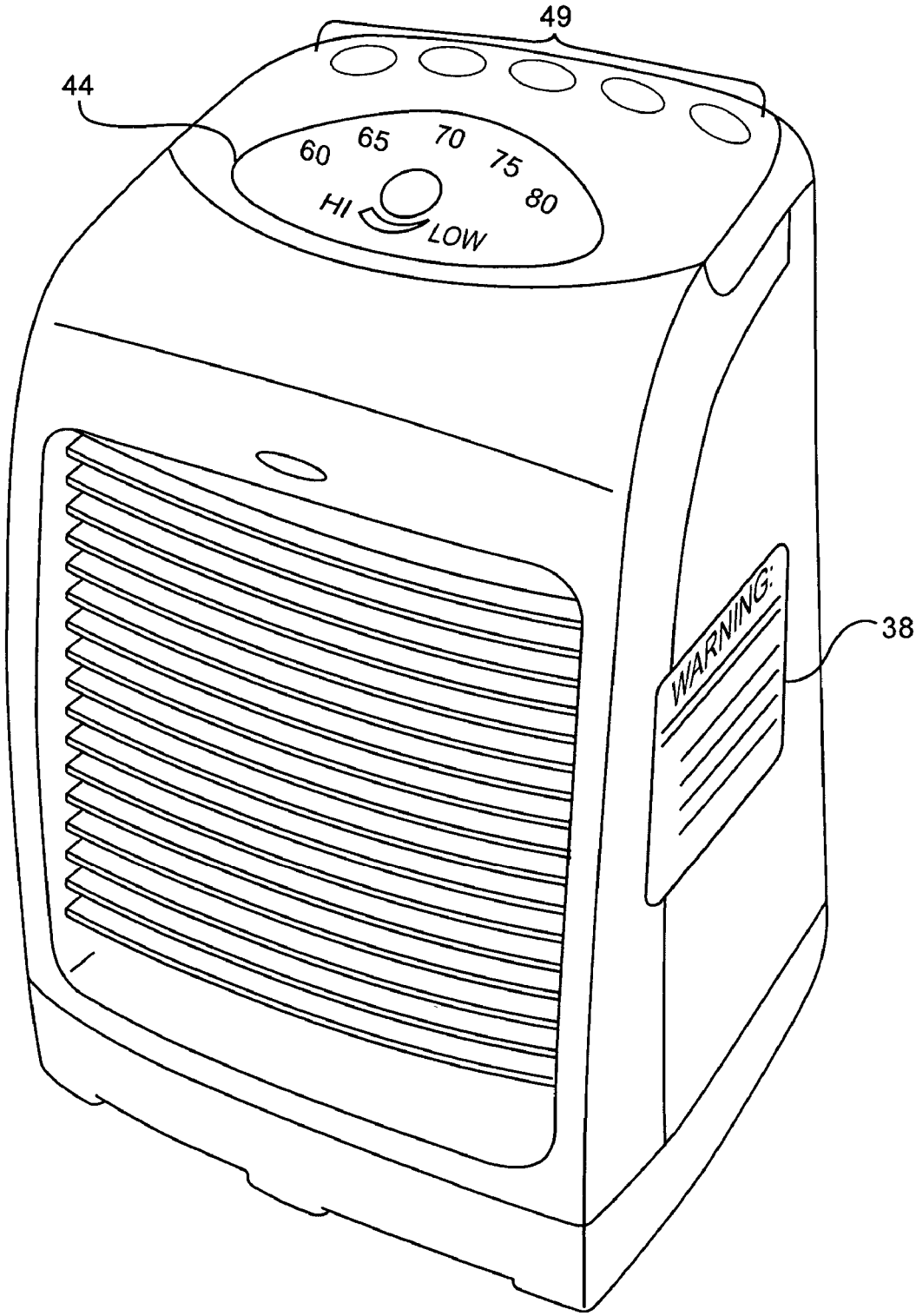

In FIG. 11, the key or warning label 38 is preferably placed on a side face of the heater and the status of the various diagnostics is indicated by the illumination of icons 48 on the top surface of the heater. In FIG. 12, the key or warning label 38 is preferably placed on a side face of the heater and the status of the various diagnostics is indicated by LEDs 49 illuminated in proximity to icons corresponding to the associated diagnostic test on the top surface of the heater.

Although illustrative embodiments of the present invention have been described herein with reference to the accompanying drawings, it is to be understood that the invention is not limited to those precise embodiments and that various other changes and modifications may be effective therein by one skilled in the art without departing from the scope or spirit of the invention.

What is claimed is:

1. A portable electric appliance comprising:

at least one electrically operable element associated with a safety feature of the portable electric appliance, the safety feature preventing operation of the portable electric appliance based on at least one of an orientation of the portable electric appliance or an object covering at least a portion of an output of the portable electric appliance; and a diagnostic testing circuit adapted to determine operability of the at least one electrically operable element, the diagnostic testing circuit being adapted to indicate whether the at least one electrically operable element is or is not operable and to prevent an operation of the portable electric appliance when the at least one electrically operable element is not operable independent of whether the portable electric appliance is capable of operating properly.

2. The portable electric appliance defined by claim 1, wherein the at least one electrically operable element comprises at least one of a tilt switch, a breaker, a fuse, and an object sensing circuit.

3. The portable electric appliance defined by claim 1, wherein the portable electrical appliance comprises at least one of a heater, a humidifier, a dehumidifier, and a fan.

4. The portable electric appliance defined by claim 1, wherein the diagnostic testing circuit determines operability of the at least one electrically operable element by detecting at least one of a voltage, signal, and ground associated with the at least one electrically operable element.

5. The portable electric appliance defined by claim 1, wherein the diagnostic testing circuit indicates operability of the at least one electrically operable element at least one of visually and audibly.

6. The portable electric appliance defined by claim 1, wherein the diagnostic testing circuit is electrically coupled to a power source such that operability of the at least one electrically operable element can be determined in response to the portable electric appliance being at least one of connected to power, and turned on.

7. The portable electric appliance defined by claim 1, wherein the diagnostic testing circuit determines operability of the at least one electrically operable element at least one of in response to user activation, periodically, in response to the portable electric appliance being connected to power, and in response to the portable electric appliance being turned on.

8. The portable electric appliance defined by claim 1, wherein the diagnostic testing circuit comprises at least one of a microcontroller, application specific integrated circuit (ASIC), and microprocessor.

9. The portable electric appliance defined by claim 2, wherein the object sensing circuit comprises:

a transmitter adapted to transmit a beam of radiation; and a receiver responsive to the beam of radiation, the receiver being positioned to receive the beam of radiation, the portable electric appliance being de-energized in response to the beam of radiation being at least one of blocked and interrupted.

10. A method of diagnosing a failure in a portable electric appliance comprising:

providing at least one electrically operable element associated with a safety feature of the portable electric appliance, the safety feature preventing operation of the portable electric appliance based on at least one of an orientation of the portable electric appliance or an object covering at least a portion of an output of the portable electric appliance;

testing a voltage associated with the at least one electrically operable element to determine operability of the at least one electrically operable element; and indicating whether the at least one electrically operable element is or is not operable; and preventing an operation of the portable electric appliance when the at least one electrically operable element is not operable independent of whether the portable electric appliance is capable of operating properly.

11. A method of diagnosing a failure in a portable electric appliance defined by claim 10, wherein providing at least one electrically operable element comprises providing at least one of a tilt switch, a breaker, a fuse, and an object sensing circuit.

12. A method of diagnosing a failure in a portable electric appliance defined by claim 10, wherein the portable electrical appliance comprises at least one of a heater, a humidifier, a dehumidifier, and a fan.

13. A method of diagnosing a failure in a portable electric appliance defined by claim 10, further comprising indicating operability of the at least one electrically operable element at least one of visually and audibly.

14. A method of diagnosing a failure in a portable electric appliance defined by claim 10, further comprising coupling the diagnostic testing circuit electrically to a power source such that operability of the at least one electrically operable element can be determined in response to the portable electric appliance being at least one of connected to power and turned on.

15. A method of diagnosing a failure in a portable electric appliance defined by claim 10, wherein the diagnostic testing circuit determines operability of the at least one electrically operable element at least one of in response to user activation, periodically, in response to the portable electric appliance being connected to power, and in response to the portable electric appliance being turned on.

16. A method of diagnosing a failure in a portable electric appliance defined by claim 10, wherein the diagnostic testing circuit comprises at least one of a microcontroller, application specific integrated circuit (ASIC), and microprocessor.

17. A method of diagnosing a failure in a portable electric appliance defined by claim 11, further comprising:

transmitting a beam of radiation;

receiving the beam of radiation; and de-energizing the portable electric appliance in response to the beam of radiation being at least one of blocked and interrupted.

18. A portable electric appliance comprising:

at least one electrically operable element comprising at least one of a tilt switch, a breaker, a fuse, and an object sensing circuit, the object sensing circuit comprising a transmitter being mounted on an external surface of a housing of the portable electric appliance and being adapted to transmit a beam of radiation and a receiver responsive to the beam of radiation, the receiver being opposingly positioned to the transmitter to receive the beam of radiation, the portable electric appliance being configured to be de-energized in response to an object independent of the portable electric appliance at least one of blocking and interrupting the beam of radiation; and a diagnostic testing circuit adapted to determine operability of the at least one electrically operable element, the diagnostic testing circuit being adapted to indicate whether the at least one electrically operable element is or is not operable independent of whether the portable electric appliance is capable of operating properly.

19. The system of claim 1, wherein the at least one electrically operable element comprises an object sensing circuit having a transmitter disposed on a housing of the portable electric appliance on a first side of an output of the portable electric appliance and a receiver disposed on the housing on a second side of the output so that the transmitter and the receiver are opposing positioned, the transmitter being configured to transmit a beam of radiation through free space and the receiver being configured to receive the beam of radiation directly from the transmitter, the portable electric appliance being de-energized in response to the beam of radiation being at least one of blocked and interrupted.

20. The system of claim 19, wherein the beam of radiation transmitted by the transmitter includes an encoded signal that is decoded at the receiver, operability of the object sensing circuit being determine based on whether a valid encoded signal is received at the receiver.

* * * * *

UNITED STATES PATENT AND TRADEMARK OFFICE

CERTIFICATE OF CORRECTION

PATENT NO. : 7,532,810 B2
APPLICATION NO. : 11/524685
DATED : May 12, 2009
INVENTOR(S) : Jayaram et al.

It is certified that error appears in the above-identified patent and that said Letters Patent is hereby corrected as shown below:

Column 6, line 33:

Now reads: "pin 111"

Should read: --pin 11--.

Signed and Sealed this

Twenty-seventh Day of July, 2010

David J. Kappos

David J. Kappos
*Director of the United States Patent and Trademark Office*